United States Patent [19]

Krieger

[11] 4,158,326

[45] Jun. 19, 1979

[54] CONTROL DEVICE

[75] Inventor: Karl Krieger, Wuppertal, Fed. Rep. of Germany

[73] Assignee: Hermann Hemscheidt Maschinenfabrik, GmbH & Co., Wuppertal, Fed. Rep. of Germany

[21] Appl. No.: 830,892

[22] Filed: Sep. 6, 1977

[30] Foreign Application Priority Data

Sep. 7, 1976 [DE] Fed. Rep. of Germany ..... 2640185

[51] Int. Cl.[2] ..... F15B 11/20

[52] U.S. Cl. ..... 91/508; 60/DIG. 10; 137/315; 91/530; 405/302

[58] Field of Search ..... 91/414, 170 MP; 137/315; 60/458, DIG. 10; 61/45 C

[56] References Cited

U.S. PATENT DOCUMENTS

| | | | |
|---|---|---|---|
| 3,215,158 | 11/1965 | Bass et al. | 137/115 X |
| 3,906,727 | 9/1975 | Hull | 60/DIG. 10 X |
| 4,049,014 | 9/1977 | Johnson et al. | 137/115 |

FOREIGN PATENT DOCUMENTS

| | | | |
|---|---|---|---|
| 2714160 | 3/1977 | Fed. Rep. of Germany | 91/414 |

*Primary Examiner*—Edgar W. Geoghegan
*Attorney, Agent, or Firm*—Berman, Aisenberg & Platt

[57] ABSTRACT

A control device for controlling hydraulically actuated equipment, the device comprising a fluid distributing block and a plurality of control valve units detachably mounted side-by-side on the block, the block being formed with an inlet opening, an outlet opening, a plurality of control line openings, a plurality of delivery openings, a plurality of return openings, a plurality of valve unit communicating openings, and internal passage means, the said internal passage means connecting the inlet opening with each of the delivery openings, connecting the outlet opening with each of the return openings, and connecting the control line opening with respective corresponding ones of the valve unit communicating openings.

9 Claims, 5 Drawing Figures

CONTROL DEVICE

Figure 1:
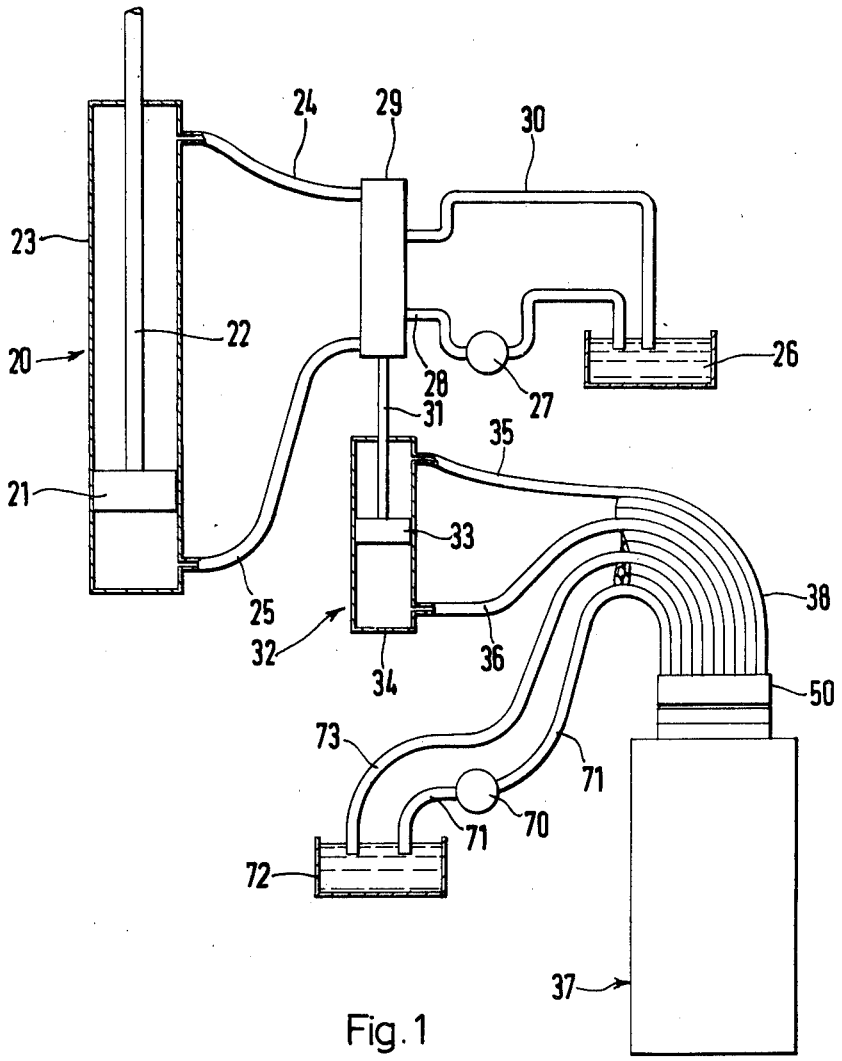

This invention relates to a control device incorporating a plurality of control valves for use in controlling the operation of hydraulically actuated equipment, such as equipment used in mining.

Mine roofs are often supported at a working face by supports known as "walking" roof supports. Each such support has a number of double acting hydraulically actuated rams some of which are used for advancing and retreating the support relative to the working face, and others of which are used for extending and retracting the support relative to the mine roof. The rams comprise pistons movable in cylinders fed by high-pressure fluid, and according to whether a particular ram is to be extended or retracted, fluid is fed to the ram cylinder on one side of the ram piston or the other. Naturally, the side of the piston not connected to the source of fluid under pressure is connected to a fluid reservoir for the return of fluid expelled from the cylinder by the advancing piston.

Pressure supply valves which control the flow of fluid to and from the rams are sometimes themselves controlled by switching units. These switching units, like the rams, can be double acting devices having two fluid lines each of which serves alternatively as a supply line and then as a return line as the switching unit is first moved to one operating position and then to another operating position. Thus, the flow of fluid in each of the two fluid lines connected to a switching unit is controlled by a respective control valve operable selectively to connect the line either to a source of fluid under pressure or to a fluid reservoir. The switching units can be operated by fluid at low pressure, in contrast to the rams of the walking roof supports which require fluid under high pressure to operate them.

It is known to provide a control device comprising a unit having a number of control valves for operating respective switching units associated with one roof support. In order to protect a worker from danger of possible roof collapse whilst he is operating such a control device, it is known to mount the control device for actuating the rams of one walking roof support on a next adjacent roof support. By this means a worker operating the rams of one roof support will be protected by the adjacent roof support on which the control device is mounted.

The necessary fluid lines connecting the control device to its associated switching units are usually of narrow bore and are held together in a bundle to form a hose-line extending between adjacent walking roof supports.

A disadvantage of some of the known control devices is that should they malfunction, it is extremely difficult to repair them in situ. The reasons for this are that the device is a very compact construction, and there is a likelihood of dust or dirt getting into the control device whilst it is disassembled.

It is therefore an aim of the invention to provide an improved control device which can be more easily repaired or serviced in situ and with less risk of the control valves of the control device becoming contaminated by dust or dirt. With this aim in view, the invention is directed to a control device for controlling hydraulically actuated equipment, the device comprising a fluid distributing block and a plurality of valve units detachably mounted side-by-side on the block, the block being formed with an inlet opening, an outlet opening, a plurality of control line openings, a plurality of delivery openings, a plurality of return openings, a plurality of valve unit communicating openings, and internal passage means, said internal passage means connecting the inlet opening with each of the delivery openings, connecting the outlet opening with each of the return openings, and connecting the control line openings with respective corresponding ones of the valve unit communicating openings, the valve units each comprising a housing having first, second and third openings, an operating member, and a valve member movable within the housing by means of the operating member between two operating positions, the valve member when in its first position connecting the first opening with the second opening, and when in its second operating position connecting the first opening to the third opening, the said first opening of each valve unit registering with a said valve unit communicating opening of the block, the said second opening of each valve unit registering with a said delivery opening of the block, and the said third opening of each valve unit registering with a said return opening on the block.

When a control device according to this invention is used to control a walking roof support described above, the inlet opening on the block will be connected to a source of fluid under pressure, the outlet opening will be connected to a fluid reservoir, and each control line opening will be connected to a control line of a switching unit.

Thus, each control line can be connected selectively by its associated control valve with a source of fluid under pressure or with a fluid reservoir, so that rams of a walking roof support can be operated as desired.

In a preferred arrangement, each valve unit includes two of the valve members and two of the operating members (for example push buttons), and in this case the housing of the control valve unit must have a further one of the said first openings. However the said second and third opening could be shared by both valves in the valve unit. In an arrangement in which each valve unit has two valves, then in use of the control device the two control lines controlled by the two valves of a valve unit can be the two lines which control a single switching unit.

Figure 2:
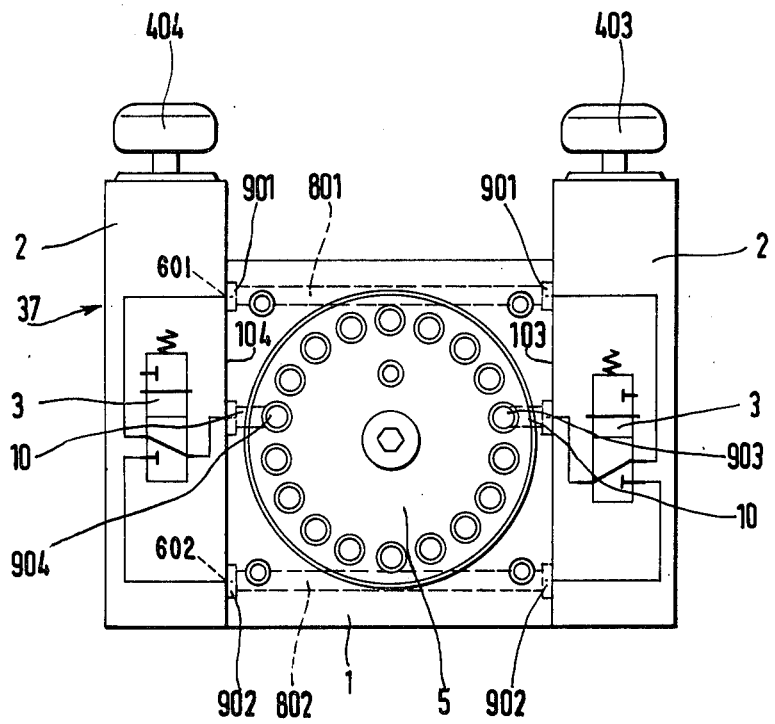
Figure 3:
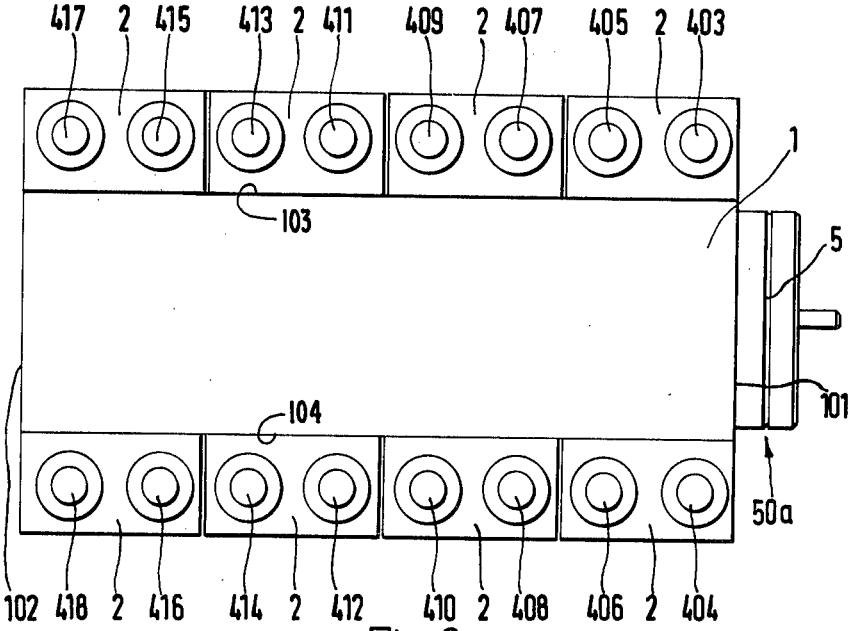
Figure 4:
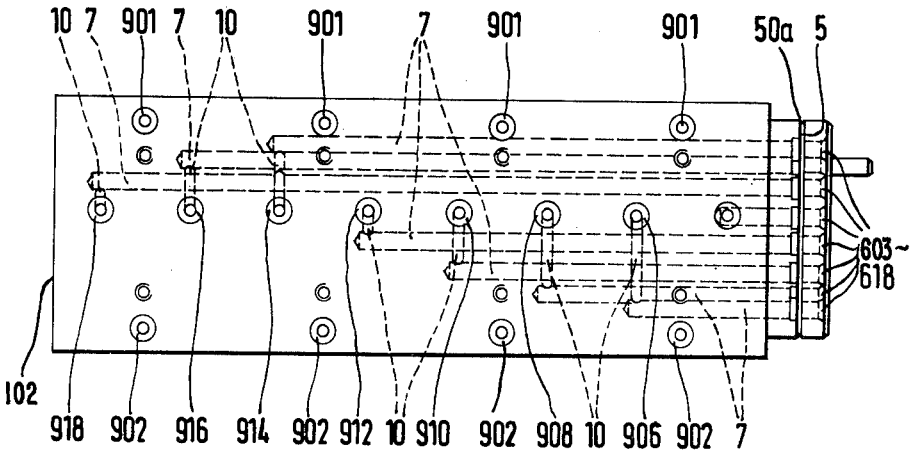
Figure 5:
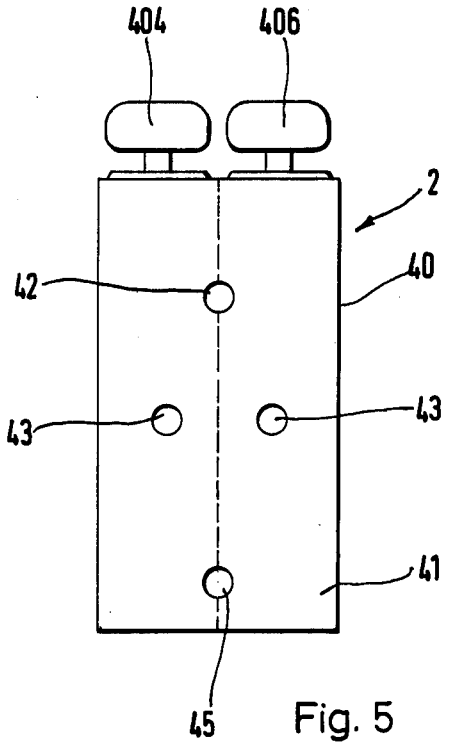

A preferred embodiment of a control device according to the invention will now be described by way of example and with reference to the accompanying drawings in which:

FIG. 1 is a diagrammatic view, not to scale, showing a ram of a walking roof support and a main valve for operating such ram, FIG. 2 is a diagrammatic front view of a control device incorporating a plurality of control valves used for controlling main valves of rams such as the ram shown in FIG. 1, FIG. 3 is a top plan view of the control device shown in FIG. 2, FIG. 4 is a side view of the control device shown in FIGS. 2 and 3 but with valve units incorporating individual control valves removed, and FIG. 5 is a view of one of said valve units.

FIG. 1 shows diagrammatically a ram 20 of a walking roof support. Such walking roof support will include a number of such rams, some of which will be used in known manner to advance or retreat the support relative to a working face, and others of which will be used for extending and retracting the support relative to the roof. The illustrated ram 20 is double acting, and comprises a piston 21 mounted on a piston rod 22 and slidable in a cylinder 23. The cylinder 23 has connected to it two fluid flow lines 24 and 25, the line 24 communicating with the ram cylinder 23 on one side of the piston 21, whilst the fluid flow line 25 communicates with the ram cylinder 23 on the other side of the piston 21.

A reservoir of hydraulic fluid is shown at 26, and a pump 27 serves to deliver fluid under high pressure by means of a delivery line 28 to a main valve 29, which is shown diagrammatically. The main valve 29 has a return line 30 communicating with the reservoir 26. The internal construction of the main valve 29 is not shown, and the valve may be of any known type suitable for the intended purpose. The valve 29 is operable between two positions by means of an actuating rod 31. In a first of the positions the valve 29 supplies fluid under high pressure from the pump 27 and reservoir 26 via the fluid line 25 to the cylinder 23 on one side of the piston 21. This causes the ram 20 to extend, and fluid expelled from the ram cylinder 23 by the advancing piston 21 flows via line 24 to the valve 29 and thence to the reservoir 26. In the other operating position of the main valve 29, the flow of fluid is reversed by the main valve so that the ram is retracted. The actuating rod 31 of the main valve 29 is itself arranged to be moved by means of a switching unit shown diagrammatically at 32. The switching unit 32, like ram 20, is a double-acting device, and comprises a piston 33 connected to the actuating rod 31 of the main valve 29 and slidably disposed in a cylinder 34. Connected to the cylinder 34 of the switching device 32, one on either side of the piston 33, are a pair of fluid flow lines 35 and 36. Fluid under low pressure can be fed to the switching unit 32 selectively either via the line 35 or via the line 36. The switching device 32 operates in a manner similar to the ram 20, so that the main valve 29 can be moved between its operating positions by supplying fluid under low pressure either to line 35 or line 36.

The source of fluid under low pressure for operating the switching device is a pump 70 delivering fluid via a line 71 from a reservoir 72 to which a return line 73 is connected.

The supply of fluid to the various switching units 32 associated with a walking roof support is controlled by a control device 37 which is connected by means of a connector 50 to a hoseline 38. This hoseline contains a bundle of fluid flow lines and includes lines 71 and 73 which are connected to reservoir 72, lines 35 and 36 associated with the illustrated switching unit 32, and fourteen other lines associated with seven other switching units (not shown). As will be described in more detail below, the control device 37 includes sixteen control valves 3, one for each switching unit line 35, 36 to be controlled.

As shown in FIGS. 2 to 5, the control device 37 comprises a fluid distributing block 1 of rectangular cross-section having end walls 101 and 102 and longitudinal walls extending between the end walls. Two of the longitudinal walls are comprised by side walls 103 and 104 which are disposed opposite one another.

The surface 5 of the block 1 formed with a plurality of openings arranged on the circumference of a circle on the end face 101, and such end face is constructed as one part 50*a* of the plug-in connector 50, FIG. 1. The openings comprise an inlet opening 601 (FIG. 2) which is connected to supply line 71 by connector 50, an outlet opening 602 diametrically opposite opening 601, which outlet opening is connected to fluid reservoir return line 73 by connector 50, and sixteen openings 603–618, each of which openings may be termed control line openings because they are connected by means of connector 50 to respective ones of the sixteen lines (such as lines 35 and 36) connected to switching units.

Within the block 1, the inlet opening 601 is connected by way of an axial passage 7 to each of four transverse passages 801, one of which is shown in FIG. 2. These passages 801 open onto opposite side faces 103 and 104 of the block 1 at openings 901. Openings 901 are equally spaced apart along each side face 103 or 104, and each opening 901 on one side face 103 or 104 is directly opposite an opening 901 on the opposite side face.

The outlet opening 602 is connected by way of an axial passage 7 to each of four transverse passages 802, one of which is shown in FIG. 2. These passages 802 open onto opposite side faces 103 and 104 of the block 1 at openings 902. Openings 902 are equally spaced apart along each side face 103 or 104, and are directly below the openings 901.

Each of the openings 603 to 618 is connected within block 1 by way of a respective axial passage 7, a vertical passage 10, and a transverse passage (not shown), to a corresponding one of a plurality openings 903 to 918. These openings 903 to 918 are disposed in two rows of eight, one row on each of the sides 103 and 104 of the block 1. The openings 904, 906, 908, 910, 912, 914, 916 and 918 are arranged in line equally spaced apart along side face 104 of block 1 between the row of openings 901 and the row of openings 902.

As best seen in FIG. 3, eight of valve units 2 are detachably connected to the block 1 by means not shown, the valve units being arranged four side-by-side on each of the faces 103 and 104 of the block, each valve unit 2 comprising two of the control valves 3 each of which has a valve member movable in a valve unit housing.

As shown in FIG. 5, each valve unit has a face 41 which will abut one of the side faces 103 or 104 of the block 1. Face 41 has four openings on it. The upper opening 42, common to both valves 3, will register with a corresponding opening 901 on block 1, the two central openings 43, each belonging to a respective valve 3, register with respective ones of the openings 903 to 918, and the lower opening 45, common to both valves 3 registers with one of the openings 902.

The precise internal construction of each control valve 3 is not of great importance, and therefore such internal construction will not be described in detail. The important feature of each control valve 3 is that it should be operable by a push button 403–418 between two operating positions, the opening 43 of the valve 3 communicating within the valve 3 with opening 42 in one such operating position, and with opening 45 in the other operating position. Operation of the control device 37 will now be briefly described.

Each individual control line 35 or 36 or a switching unit 32 is connected by way of connector 50 to a respective control line opening 603 to 618, and thence by way of passages 7 and 10 to a respective one of the valve unit communicating openings 903 to 918 on the block 1 which register with valve unit openings 43. By way of the valve 3 associated with the appropriate one of the openings 903 to 918, such opening can be connected selectively either via opening 45 to a return opening 902 leading to outlet opening 602, or via opening 42 to a delivery opening 901 fed from inlet opening 601.

Thus, by way of (for example) push buttons 404 and 406 of a single valve unit 2, one control line 35 or 36 of a switching unit 32 can be connected to return line 73, whilst the other control line is connected to a source of low pressure hydraulic fluid, i.e. pump 70. By appropriate operation of buttons 404 and 406 the switching unit can be moved to a selected operating position to control actuation of a ram 20 by means described above.

A particular advantage of the described control device 37 is that should a malfunction or leak occur in the control device 37, it is merely necessary to replace the appropriate valve unit 2 which is designed to be readily detachable and is easily accessible. There is little risk of contamination of the control device 37 by dust or dirt whilst the valve unit 2 is being replaced. Also, the control device can be manufactured relatively cheaply.

The control device 37 will be mounted on one roof support, and will be connected by hoseline 38 to the switching units of an adjacent roof support. It is also possible for the control device to be connected to the switching units of two adjacent roof supports, one on each side of the support on which the control unit is mounted.

What is claimed is:

1. A control device for controlling hydraulically actuated equipment, the device comprising a fluid distributing block and a plurality of control valve units detachably mounted side-by-side on the block, the block being formed with an inlet opening, an outlet opening, a plurality of control line openings, a plurality of delivery openings, a plurality of return openings, a plurality of valve unit communicating openings, and internal passage means, said internal passage means connecting the inlet opening with each of the delivery openings, connecting the outlet opening with each of the return openings, and connecting the control line openings with respective corresponding ones of the valve unit communicating openings, the control valve units each comprising a housing having first second and third openings, an operating member, and a control valve member movable within the housing by means of the operating member two operating positions, the control valve member when in its first position connecting the first opening to the second opening, and when in its second operating position connecting the first opening to the third opening, the said first opening of each valve unit registering with a said valve unit communicating opening of the block, the said second opening of each valve unit registering with a said delivery opening of the block, and the said third opening of each valve unit registering with a said return opening of the block.

2. A control device as claimed in claim 1, in which each said control valve unit includes two said control valve members and two said operating members, and in which the control valve unit housing has two of said first openings registering with corresponding ones of said valve unit communicating openings on the block.

3. A control device as claimed in claim 2, in which said block is formed with two end faces, and with longitudinal faces extending between the end faces, the said outlet opening, inlet opening, and control line openings all being disposed on a said end face of the block.

4. A control device as claimed in claim 3, in which said end face of the block having said openings thereon is constructed as one part of a plug-in connector.

5. A control device as claimed in claim 4 in which said openings on said end face are disposed on the circumference of a circle.

6. A control device as claimed in claim 3, in which the said delivery openings, the return openings, and the valve unit communicating openings are disposed on a pair of said longitudinal faces, said longitudinal faces being opposite one another, the control valve units being disposed in two groups, one group on each of said opposite longitudinal faces, each control valve unit on one longitudinal face being disposed directly opposite a corresponding control valve unit on the opposite longitudinal face.

7. A control device as claimed in claim 6, in which the said internal passage means comprise axial passages extending from the openings, in the endface of the block along the block, and transverse passages connecting the axial passages with the said openings on said longitudinal block faces, the openings on the longitudinal block faces being symmetrically disposed.

8. A control device as claimed in claim 1, and further comprising: a walking roof support; rams for operating said walking roof support; a source of high pressure fluid; main valves for controlling the supply of high pressure fluid to said rams; switching units for actuating said main valves; a source of fluid under low pressure; a fluid reservoir; a return line connecting the outlet opening to said fluid reservoir; control lines connecting said switching units to respective control line openings of said control device block; and a line connecting the source of fluid under low pressure to said inlet opening of the block;

9. A control device as claimed in claim 8, and comprising two said control lines connected to each said switching unit, and two said control valve members which serve to control the supply of fluid to said two control lines, said two control valve members being incorporated in a single said valve unit.

* * * * *